United States Patent [19]

Pieper et al.

[11] 4,347,989

[45] Sep. 7, 1982

[54] SPINNING MACHINE FOR SYNTHETIC THREADS

[75] Inventors: Werner Pieper, Radevormwald; Reinhard Worpenberg, Remscheid, both of Fed. Rep. of Germany

[73] Assignee: Barmag Barmer Maschinenfabrik AG, Remscheid-Lennep, Fed. Rep. of Germany

[21] Appl. No.: 227,912

[22] Filed: Jan. 23, 1981

[30] Foreign Application Priority Data

Jan. 26, 1980 [DE] Fed. Rep. of Germany ..... 3002849

[51] Int. Cl.[3] ..... B65H 54/20

[52] U.S. Cl. ..... 242/35.5 R; 57/1 R; 242/18 DD; 242/35.5 A

[58] Field of Search ..... 242/35.5 R, 35.5 A, 242/35.6 R, 18 R, 18 DD, 1; 57/1 R, 291; 181/200, 205

[56] References Cited

U.S. PATENT DOCUMENTS

| | | | |
|---|---|---|---|
| 3,146,572 | 9/1964 | Keyser | 57/1 R |
| 3,782,087 | 1/1974 | Franzen et al. | 57/1 R |
| 3,955,347 | 5/1976 | Schippers | 57/1 R |
| 3,977,169 | 8/1976 | Suzuki et al. | 57/1 R |
| 4,036,000 | 7/1977 | Greive | 57/1 R |
| 4,083,505 | 4/1978 | Burkhardt | 242/35.5 R X |

FOREIGN PATENT DOCUMENTS

| | | | |
|---|---|---|---|
| 528612 | 11/1972 | Switzerland | 57/1 R |

*Primary Examiner*—Stanley N. Gilreath
*Attorney, Agent, or Firm*—John H. Shurtleff

[57] ABSTRACT

Apparatus and a threading method in a multi-unit spinning machine for synthetic fibers with an exposed front face of each winding unit, the apparatus comprising a soundproofing screen extending across at least one winding unit, means to move the screen along the front of the machine to offer soundproofing protection as the winding unit is placed into operation, and thread insertion means in the screen including an open-ended thread insertion slot extending longitudinally of the screen from its leading side edge. The threading method permits the simultaneous actuation of a winding unit and moving of the soundproofing screen into place as the unit is threaded with the help of a suction gun.

8 Claims, 2 Drawing Figures

SPINNING MACHINE FOR SYNTHETIC THREADS

BACKGROUND OF THE INVENTION

Spinning machines for synthetic yarns or threads are driven today at very high thread running speeds of more than 3,000 meters per minute, thereby causing a very high level of noise which can be most disturbing to those persons who must work around these machines. These noises arise especially from the winding devices which have a large number of mechanically moving parts. The noise factor is especially evident when the mechanically moving parts stand in engagement with one another, as is the case for example when using a roller drive for the winding or when applying a contact roller to measure the surface velocity of the bobbin package as it is being wound.

It is not possible to adopt a total soundproof lining or encasement of the machine because such a complete enclosure would seriously hinder the operating accessibility of the machine and it would become impossible to visually monitor the machine during operation. Furthermore, problems of overheating arise due to stagnant heated air if noise is isolated by means of a completely enclosed sound-insulated housing.

SUMMARY OF THE INVENTION

One object of the present invention is to ensure adequate soundproofing of thread spinning and winding machines for the protection of operating personnel.

More particularly, it is an object of the invention to permit an unobstructed view of the front or facing side of each winding unit during most of its operation while providing a soundproofing shield or screen which is movable along the front of the machine and which covers at least one up to a few winding places. This shield or screen is preferably carried along manually by the operator as individual winding units are serviced, the screen preferably being mounted on an undercarriage having a number of wheels for movement along a substantially horizontal track means having at least one rail extending along the length of the machine.

The soundproofing screen can be easily arranged to travel far enough beyond one or both ends of the machine so as to cover not more than one winding unit. In a preferred embodiment where the sound proofing screen extends over the width of only one winding unit, the screen and the means to move the screen do not have to extend beyond the machine ends.

Still another object of the invention is to facilitate thread insertion as each winding unit is serviced by means of a screen which is constructed and arranged to provide an open-ended thread insertion slot. This thread insertion slot should extend longitudinally of the machine from the leading side edge of the screen which is located on the same side of each winding unit as its thread feed plane. This slot may extend horizontally or also somewhat included from the leading side edge of the screen which is also located substantially beneath the thread feed path leading into a triangular thread traversing plane. In those winding arrangements where the bobbin spindles project perpendicularly to the machine front, it will be noted that the thread is fed into the winding unit on a plane perpendicular to the machine front and at this point, forms the traverse triangle.

The thread insertion slot lies below this triangle and preferably below the position of the bobbin spindle.

The thread insertion slot can be formed by arranging at least part of the lower edge of the screen in a somewhat raised position, i.e. so that a narrow slot is provided between a lower edge of the stand or base of the winding units and this lower edge of the screen.

Yet another object of the invention is to provide a screen which is guided and moved only by the undercarriage with each of its wheels engaging the track rails at two points, one above the other, so that the screen cannot tilt. With the screen thus mounted exclusively from below the winding spindle, the traversing means and feed guide means for starting and running the thread onto a bobbin, it is possible to avoid tracking guides in the upper zones of the spinning machine which would greatly hamper or restrict the tending of a winding unit by the operator.

The winding units of the spinning machine are preferably lined for purposes of the invention especially on the two sides of each unit and also at the base or bottom side by soundproof wall liners, e.g. in boxlike manner. With this arrangement, the screen substantially overlaps and covers the facing edges or exposed faces corresponding to the cross-section of this boxlike liner.

In the following description, the invention is described as one preferred embodiment of a commercial installation which is intended to be illustrative and not exclusive.

THE DRAWINGS

FIG. 1 is a front elevational view of the spinning installation according to the invention; and FIG. 2 is a side elevational view of the same synthetic fiber spinning installation.

In each of the drawings, the boxlike soundproof wall liners are shown in simulated cross section, so as to be readily identifiable. The shield or screen of FIG. 1 is mounted on an undercarriage and double track means, only part of the track means being shown in a cross-section. In FIG. 2, both the shield and the track means are illustrated in a partial cross-section.

DETAILED DESCRIPTION OF THE INVENTION

Figure 1:
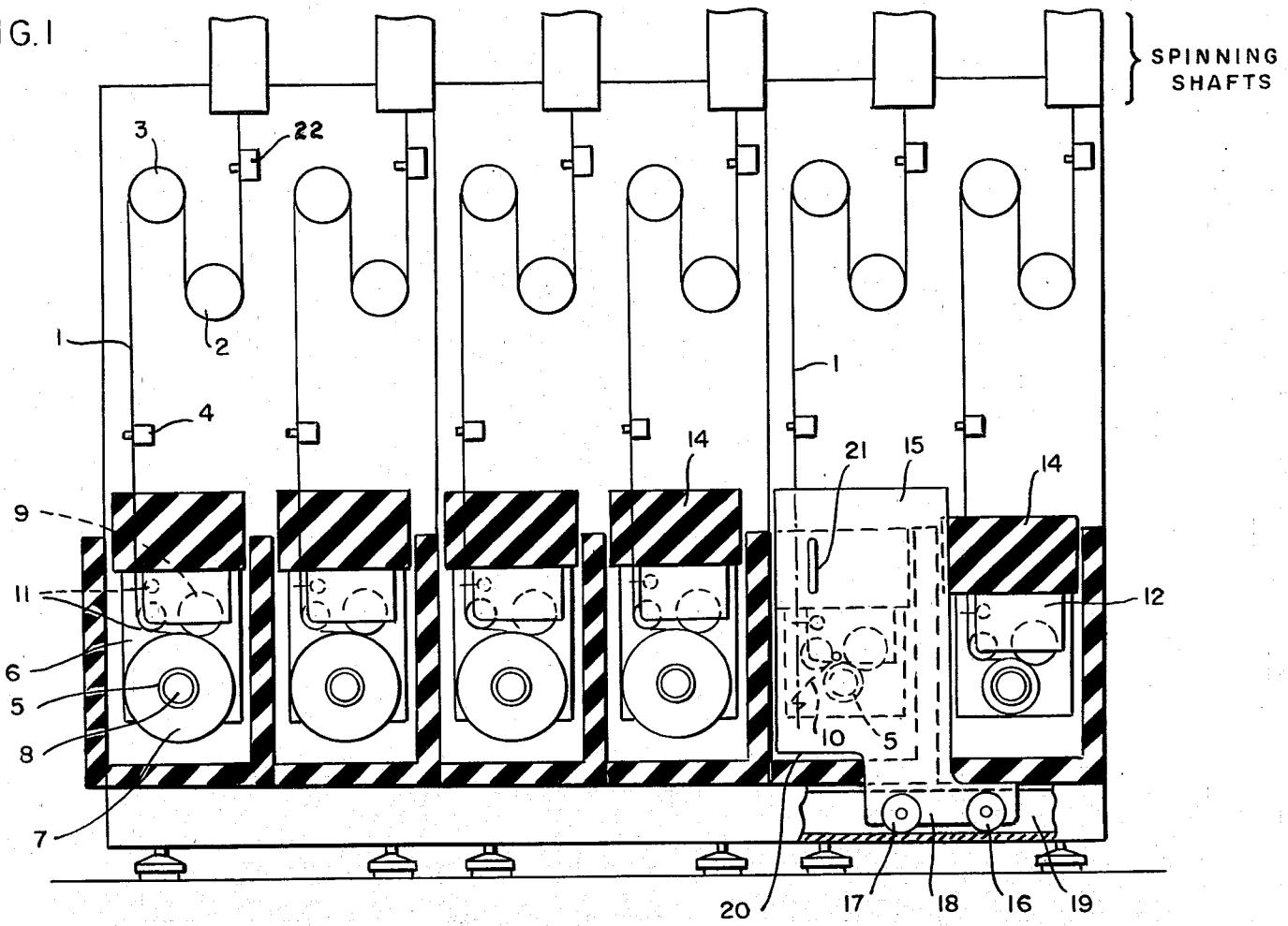
Figure 2:
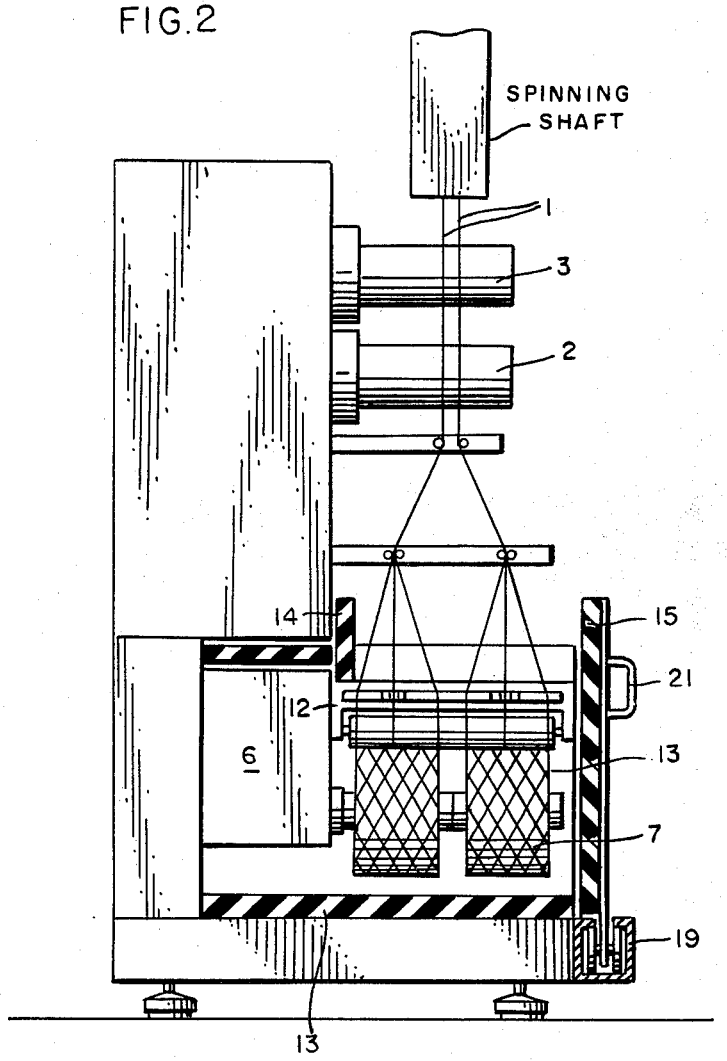

The synthetic fiber spinning installation as shown in FIGS. 1 and 2 has a plurality of spinning units arranged side by side over the length of the machine. At each spinning unit a thread 1 issues from a vertical spinning shaft which is mounted overhead separately from its corresponding winding unit. This thread 1 is drawn off by the godets 2 and 3 acting as a feed or delivery means. From the godet 3 the thread runs to a winding means including the bobbin head 6 with winding tube 5 and bobbin 7 seated on the bobbin spindle 8. The drive roller 9 lies in direct contact on the bobbin 7 and drives the bobbin at a constant circumferential velocity. Through the traverse elements 11, the thread is shifted back and forth along the bobbin to sweep in a conventional traversing triangle. The traverse elements 11 together with the drive roller 9 are seated on a slide support member 12 which is guidably driven in a vertical direction, e.g. by sliding upwardly or downwardly in suitable grooves in the machine frame, so that the drive roller 9 can yield with the growing bobbin diameter and can be lifted off from the bobbin.

Spinning machines using such a winding apparatus for synthetic fibers are described, for example, in German patent application Nos. DE-OS 25 26 768 and DE-OS 25 47 401, the former corresponding to U.S. Pat. Nos. 4,083,505 and 4,146,186. In these prior patents, a suitable feed guide means 10 is also shown in greater detail, with which the continuously delivered threads 1 are initially laid onto the empty bobbin tube 5 carried by the spindle 8. The disclosures of these earlier cases are incorporated herein by reference as fully as if set forth in their entirety.

With the spinning of the synthetic fibers at speeds of more than 3,000 meters per minute, the highest noise level arises in the zone of the winding unit, especially with the mechanical movements of the traverse elements 11 and the drive roller 9. This noise makes itself troublesomely noticeable, particularly when an operator is working at the machine and also, as shown at one shielded winding place in FIG. 1, the drive roller 9 lies on the empty winding tube 5 and accelerates the bobbin spindle 8.

To reduce this noise, each winding unit is partly enclosed by the L-shaped soundproofing wall insulation 13 in a boxlike form. In addition, an acoustical back wall panel 14 is provided which is sound-absorbing and prevents noise from being radiated excessively into the machine room. This noise radiation is especially prevented in the spinning installation of the invention, however, by means of the movable soundproofing screen 15. This screen is mounted integrally with an undercarriage 18 on wheels 16,17 for movement in a rail 19 along the machine front from bobbin head to bobbin head. For the manual movement of screen 15, which is light in weight, the handle 21 is provided in a position convenient for the operator.

The undercarriage part 18 of the soundproofing screen 15 is offset somewhat in the longitudinal direction of the machine with respect to the soundproofing screen proper. The screen 14 is also seated with a leading section of its lower edge somewhat higher than the base or bottom member of the L-shaped soundproofing wall member 13. A thread insertion slot 20 is thus formed between the upper edge of the horizontal bottom soundproofing wall member 13 and the lower edge of the soundproofing screen 15.

In tending the spinning machine, the soundproofing screen 15 and various threading movements are handled by the operator as follows. First, the operator catches the thread 1 sucked in by the stationary thread suction device 22 with a manually operated suction gun (not shown), and the caught thread is then guided around godets 2 and 3 and through the thread guide at the end of the thread applying arm 10. The operator then draws the thread with the manually held suction gun out of the machine and obliquely downward, in which process the thread continues to be drawn into the suction gun. Now the operator actuates the slide member 12 by pressing an actuating button to set in motion the slide member 12 which travels downwardly with the drive roller coming in contact against the empty winding tube 5. Simultaneously, the operator moves the soundproofing screen 15 by means of handle 21 in front of the bobbin head being tended, so that the thread 1 now runs through the insertion slot 20 to the outside, i.e. in front of the machine. Next, as described in the prior patent incorporated by reference above, the feed guide means 10 is operated in a follow-up or sequence control initially triggered by the slide member control button, and the thread is laid on the empty tube 5 where it is simultaneously caught by the traverse means 11. In its application, the thread is cut off from the suction gun which the operator holds in his hand. The threading or starting operation at one bobbin head position is completed at this point, and the operator can tend the next adjacent spool head without being harmfully disturbed by the noise of the previously tended bobbin head. In particular, the protection offered by the screen 15 greatly reduces the high-frequency noises caused by the drive roller 9 on the empty tube 5 at the very beginning of the winding or after only a few thread layers have been wound.

As soon as the operator has laid the thread in the feed guide means 10 of the next bobbin head of the adjacent winding unit and has set in motion the slide support member 12 for placing the drive roller 9 in contact with tube 5, he immediately moves the soundproofing screen 15 in front of this next bobbin head. He can then turn at once to the tending of the next bobbin head to be reloaded in this same manner.

The main advantage of the present invention resides in the fact that the monitoring and tending of the machine is not impaired by additional soundproofing measures, while at the same time, the operator is largely protected against annoying and unhealthy sound levels in the critical phase of thread inserting and applying onto the winding tube and bobbin.

The invention is hereby claimed as follows:

1. In a spinning machine for synthetic fibers, including a plurality of spinning units and their associated winding units arranged side by side adjacent one another over the length of the machine, each winding unit adapted to receive thread for winding from a thread feed plane located at one side of each unit, and further including soundproofing means partly enclosing each winding unit, while leaving the front face of each winding unit exposed for access to the individual winding elements, the improvement which comprises:

a soundproofing screen having a size sufficient to extend across the exposed front face of at least one winding unit;

means to move said screen along the front of the machine; and thread insertion means in said screen including an open-ended thread insertion slot extending longitudinally of the machine from the leading side edge of the screen which is located on the same side of each winding unit at its thread feed plane.

2. The improvement as claimed in claim 1 wherein at least part of the lower edge of the screen is raised sufficiently above a lower front edge of each winding unit in order to provide said thread insertion slot.

3. The improvement as claimed in claim 2 wherein said means to move the screen includes an undercarriage upon which said screen is mounted, said undercarriage being movable on wheels running on a substantially horizontal track having at least one rail extending along the length of the machine.

4. The improvement as claimed in claim 3 wherein said undercarriage is offset from said leading side edge of the screen, the amount of offset being equal to about one-half of the distance measured between the bobbin spindles of adjacent winding units.

5. The improvement as claimed in claim 4 wherein said screen is moved and guided only by said undercarriage with each of said wheels engaging track rails at two points, one above the other, to prevent tilting of the screen.

6. The improvement as claimed in claim 1 wherein each winding unit is enclosed on either side and on the bottom by soundproof wall liners, said screen substantially overlapping and covering the facing edges of said liners.

7. The improvement as claimed in claim 6 wherein at least part of the lower edge of the screen is raised sufficiently above the lower front edge of each winding unit formed by a bottom wall liner in order to provide said thread insertion slot.

8. A method of threading winding units in a spinning machine for synthetic fibers having a plurality of spinning units and their associated winding units arranged side by side adjacent one another over the length of the machine, each winding unit being adapted to receive at least one continuously running thread from its spinning unit for winding from a thread feed plane located at one side of each unit onto a bobbin means, including an initially empty bobbin tube, rotated on a chuck and in contact with a contact roller with actuating means to place said roller in and out of contact with said bobbin means, wherein the thread is initially applied by a feed guide means to the empty bobbin tube to be caught and wound thereupon as the actuating means places the roller in contact with the tube, which method comprises:

catching the thread as it runs freely from the spinning unit with a suction gun manually operated by the person tending the machine, and first manually guiding the thread through said feed guide means;

drawing the suction gun to the outside and in front of the machine while the thread continues to run from said feed guide means to said gun;

actuating said contact roller to place it in contact with the tube as the thread is initially applied to said tube by said feed guide means; and simultaneously with said actuation of said contact roller, moving a soundproofing screen to cover the front of the winding unit just to be threaded while allowing the thread to run through a thread insertion slot in said screen into the suction gun still held outside and in front of the machine, whereby the thread winding is initiated and thereafter the next adjacent winding unit may be threaded and actuated without said person being harmfully disturbed by the noise created by the previously tended unit.

* * * * *